US009027473B2

(12) United States Patent
Fornay

(10) Patent No.: US 9,027,473 B2
(45) Date of Patent: May 12, 2015

(54) HOT STAMPING PRINTING DEVICE

(75) Inventor: Jean-François Fornay, Crissier (CH)

(73) Assignee: Bobst Mex SA (CH)

( * ) Notice: Subject to any disclaimer, the term of this patent is extended or adjusted under 35 U.S.C. 154(b) by 53 days.

(21) Appl. No.: 13/516,276

(22) PCT Filed: Dec. 3, 2010

(86) PCT No.: PCT/EP2010/007338

§ 371 (c)(1),
(2), (4) Date: Jun. 15, 2012

(87) PCT Pub. No.: WO2011/072807

PCT Pub. Date: Jun. 23, 2011

(65) Prior Publication Data

US 2012/0247352 A1 Oct. 4, 2012

(30) Foreign Application Priority Data

Dec. 18, 2009 (EP) ..... 09015660

(51) Int. Cl.
*B41F 19/06* (2006.01)
*B65H 29/68* (2006.01)

(52) U.S. Cl.
CPC ..... *B41F 19/06* (2013.01); *B65H 29/686* (2013.01); *B41F 19/068* (2013.01); *B41P 2219/00* (2013.01)

(58) Field of Classification Search
CPC ..... B41F 19/09; B41F 17/24; B65H 9/08; B65H 29/686; B65H 29/68; B41P 2219/00
USPC ..... 101/9, 11, 41, 27; 156/230, 233, 234, 156/238; 279/3; 271/183, 204
See application file for complete search history.

(56) References Cited

U.S. PATENT DOCUMENTS

| | | | | | |
|---|---|---|---|---|---|
| 2,441,912 | A | * | 5/1948 | Streich | 355/110 |
| 3,779,545 | A | * | 12/1973 | Schuhmann et al. | 271/183 |
| 3,933,351 | A | * | 1/1976 | Mayer et al. | 271/183 |
| 4,059,470 | A | * | 11/1977 | Primavesi et al. | 156/238 |
| 5,840,155 | A | * | 11/1998 | Rebeaud | 156/757 |
| 6,454,478 | B2 | * | 9/2002 | Wotton et al. | 400/656 |
| 6,497,522 | B2 | * | 12/2002 | Wotton et al. | 400/578 |

FOREIGN PATENT DOCUMENTS

| | | |
|---|---|---|
| CH | 457 207 | 5/1968 |
| EP | 0 739 722 A1 | 10/1996 |

OTHER PUBLICATIONS

International Search Report dated Apr. 7, 2011 issued in corresponding international patent application No. PCT/EP2010/007338.

* cited by examiner

*Primary Examiner* — Ren Yan
*Assistant Examiner* — Leo T Hinze
(74) *Attorney, Agent, or Firm* — Ostrolenk Faber LLP

(57) ABSTRACT

A printing device 300 for printing elements in the form of sheets 10, includes a platen press 310 which hot stamps to affix to each sheet 10 with a colored or metallized film from at least one stamping strip 320. A transport device 340 introduces each sheet 10 one after the other into the platen press 310 by pulling the sheet 10 by its front edge. The printing device 300 further includes a device 360 able to partially restrain each sheet 10 by its rear portion during the phase of introducing the sheet 10 into the platen press 310.

14 Claims, 3 Drawing Sheets

HOT STAMPING PRINTING DEVICE

CROSS-REFERENCE TO RELATED APPLICATIONS

The present application is a 35 U.S.C. §§371national phase conversion of PCT/EP2010/007338 filed Dec. 3, 2010, which claims priority of European Application No. 09015660.5, filed Dec. 18, 2009, the contents of which are incorporated by reference herein. The PCT International Application was published in the French language.

BACKGROUND OF THE INVENTION

The present invention relates to a device that allows elements in the form of sheets to be printed by hot stamping.

The invention finds a particularly advantageous, although not exclusive, application in the field of packaging for luxury goods.

It is known practice for texts and/or patterns to be printed by hot stamping, that is to say for colored or metallized film from one or more stamping strips to be applied under pressure to a support in the form of a sheet. In industry, such a transfer operation is usually performed using a vertical platen press, into which the supports for printing are introduced sheet by sheet, while the stamping strips are fed continuously.

In a standard platen press, stamping is performed between a horizontally fixed platen and a platen that is mounted such that it can move in a reciprocating vertical movement. Because this type of press is generally automated, transport means are provided to bring each sheet between the platens one by one. In practice, this is usually a series of gripper bars each of which in turn takes hold of a sheet at the front edge thereof, before pulling it in between the two platens when the latter are sufficiently parted.

This type of device does, however, have the disadvantage of guaranteeing high print quality only at low production rates, given that a crumpling phenomenon arises as soon as the stamping rate becomes too high. In its deceleration movement before it comes to a standstill between the two platens of the press, the rear portion of the sheet in fact has a tendency to catch up with the front portion carried by the gripper bar. This has the effect of appreciably disrupting the flatness of the sheet, accordingly increasing the risk of its becoming crumpled as the moving platen comes to press against the fixed platen.

One idea that has been considered, in an attempt to overcome this difficulty, is to use a blower to keep the sheet roughly flat as it comes to a standstill between the two platens of the press. The idea is for this blower to be positioned downstream of the press and for its jet of pressurized air to be directed in the plane of the sheet, so as to slow it during the deceleration phase. Be that as it may, while such an arrangement does actually allow the stamping rate to be increased, it does nonetheless also have its own limits.

Hence, the technical problem addressed by the subject matter of the invention is that of providing a printing device for printing elements in the form of sheets, comprising, on the one hand, a platen press able by hot stamping to affix to each sheet colored or metallized film from at least one stamping strip and, on the other hand, transport means able to introduce each sheet one after the other into the platen press by pulling said sheet by its front edge, which printing device would make it possible to avoid the problems of the prior art while notably offering an appreciably higher production rate.

SUMMARY OF THE INVENTION

The solution to the technical problem being addressed is, according to the present invention, for the printing device further to comprise means able to partially restrain each sheet by its rear portion during the phase of introducing said sheet into the platen press.

It must be understood that, throughout this text, the term sheet denotes very broadly any support for printing that is in the form of a sheet, such as, for example, sheets of cardboard, paper, plastic, etc.

It is also important to emphasize that the fact that the restraining means are capable of partially restraining each sheet means that they are capable of holding the rear portion of said sheet without immobilizing it, allowing it to slip progressively as the transport means pull it.

In any event, the invention as thus defined has the advantage that it can operate at production rates higher than those of its prior art counterparts. The presence of the restraining means actually makes it possible to control the attitude of the sheet upon deceleration, and therefore ensure that said sheet is held almost permanently throughout the phase of its introduction into the platen press. The speed at which the sheets are transported can thus be increased significantly without the risk of crumpling, and this ultimately allows unparalleled production rates to be achieved.

The present invention also relates to the features which will become apparent through the course of the description which follows and which are to be considered in isolation or in any technically feasible combination(s).

This description, given by way of nonlimiting example, is aimed at providing a better understanding of the substance of the invention and of how it may be embodied. It is given with reference to the attached drawings, in which:

DESCRIPTION OF A PREFERRED EMBODIMENT

For reasons of clarity, the same elements have been denoted by identical references. Likewise, only those elements that are essential to understanding the invention have been depicted, and have been so schematically and not to scale.

Figure 1:
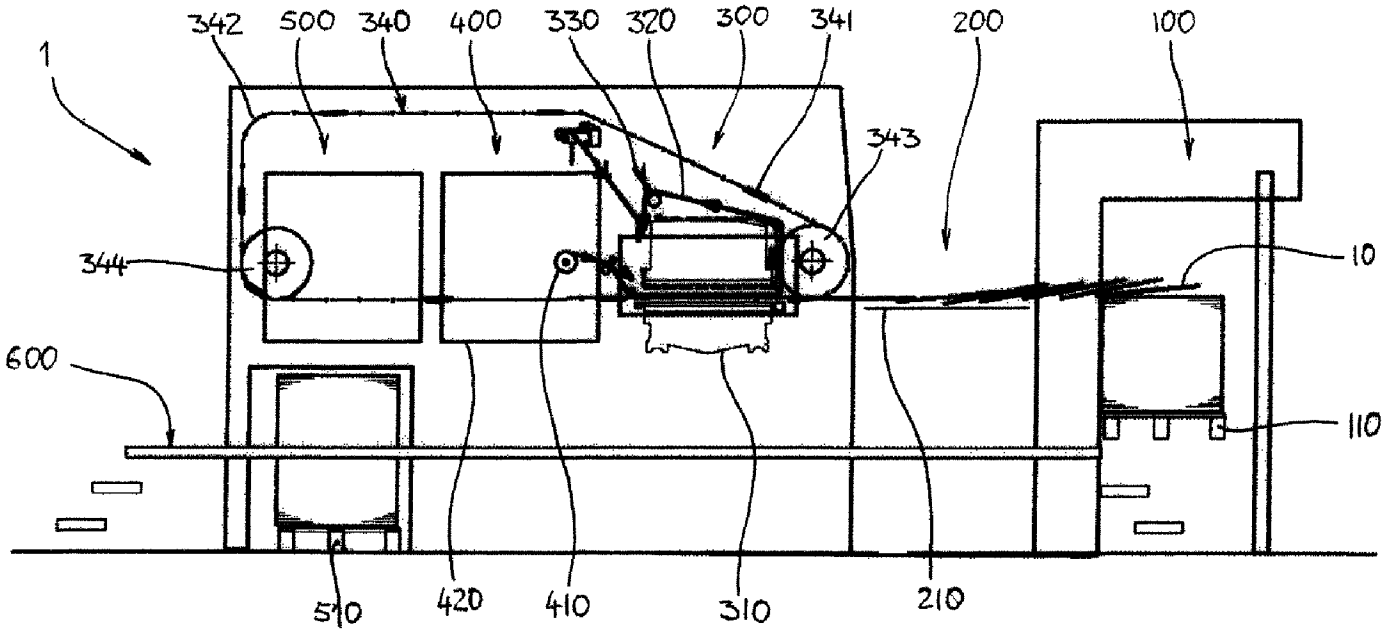
FIG. 1 illustrates a gilding machine using a printing device according to the invention.

FIG. 1 depicts a gilding machine 1 intended for personalizing cardboard packaging for the luxury goods market. This processing machine 1 is conventionally made up of several work stations, which are juxtaposed but interdependent, in order to form a unitary assembly. There is thus an introduction station 100, a feed board 200, a printing device 300, a stamping strip feed and waste removal station 400 and a collecting station 500.

As may be seen in this first schematic depiction, the introduction station 100 is fed from a pallet 110 on which a plurality of sheets of cardboard 10 are stacked. These sheets are successively picked up from the top of the pile by a suction-type gripper member capable of carrying them onto the directly adjacent feed board 200. To make the task of the gripper member easier, the pallet 110 is placed on a raising mechanism that guarantees that the top of the pile will always be positioned at a roughly constant height. It should be noted that the raising mechanism and the gripper member are entirely standard, and that it is therefore for simple reasons of clarity that they have not been depicted here.

At the feed board 200, the sheets 10 are arranged in a layer directly by the suction-type gripper member, that is to say they are placed one after the other so that they partially overlap. The entire layer is moved along an inclined surface 210 toward the printing device 300. To do that, use is made of a conventional belt-type conveyor system which once again has not been depicted for obvious reasons of clarity. At the end of the layer, the leading sheet is systematically positioned precisely using front and side guide cleats.

The work station situated just after the feed board 200 is therefore the printing device 300 that forms the subject of the invention. This device is first of all provided with a platen press 310 which is capable, by hot stamping, of a fixing onto each sheet 10 colored or metallized film, which, in this exemplary embodiment, comes from a single stamping strip 320. The printing device 300 is also provided with unwinding means 330 the task of which is to lead the stamping strip 320 into the platen press 310 and then extract it so that it can be removed as waste. Finally, the printing device 300 comprises transport means 340 the task of which is to introduce the sheets 10 into the platen press 310 one by one.

Downstream of the printing device 300 is a station 400 that has a dual role: namely the roles of feeding the device with stamping strip 320 and of removing waste. In this extremely schematic depiction, the feed aspect is embodied by the simple illustration of a reel 410 which serves to support the stamping strip 320. Waste removal itself is symbolized as a collecting pan 420 used for collecting the spent stamping strip 320, that is to say portion of the strip that has undergone stamping in the platen press 310.

The process whereby the sheets 10 are processed in the gilding machine 1 is completed in the collecting station 500, the main function of which is to repackage the sheets 10 in a stack on a transport pallet 510. To do that, the transport means 340 are arranged in such a way as to release each sheet 10 automatically when it comes into line with this new stack. The sheet 10 then drops squarely onto the top of the stack. To make stacking easier, the pallet 510 is positioned on a raising mechanism that guarantees that the top of the stack is always positioned relatively close to the transport means 340. While that is so, it may be seen here that the stack is depicted in a lowered position, that is to say that it is ready to be taken away.

Because the gilding machine 1 proves to be relatively bulky, it is also fitted with a working platform 600 which raises the position of the persons operating it or performing maintenance thereon.

Figure 2:
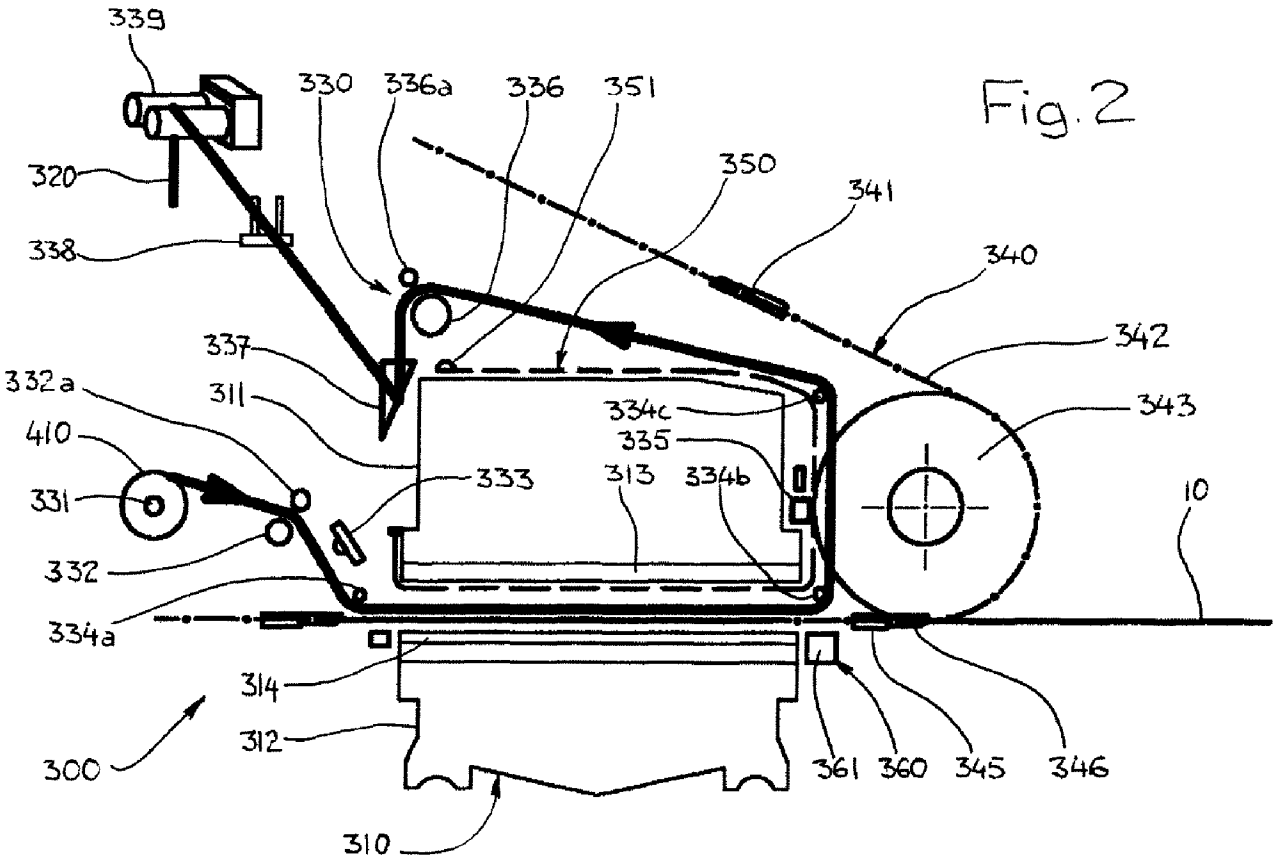
FIG. 2 shows, in detail, the printing device with which the gilding machine shown in FIG. 1 is provided.

As can be seen more clearly in FIG. 2, the printing device 300 is first of all provided with a platen press 310. In this particular embodiment, chosen solely by way of example, stamping is done between a heating upper platen bolster 311 which is fixed, and a lower platen bolster 312 which is mounted so that it can move in a reciprocating vertical movement. The heating upper platen bolster 311 supports a frame 313 under which printing blocks, not visible here, are fixed, while the lower platen bolster 312 carries a stamping plate 314 to which stamping counterparts, likewise not visible, are attached.

The printing device 300 is also provided with unwinding means 330 the task of which is to feed the platen press 310 with stamping strip 320. In an entirely conventional way, these unwinding means 330 comprise a reel holder 331 with respect to which the reel 410 is mounted so that it can rotate, a feed shaft 332 associated with press rollers 332*a*, a mark detector 333, a series of return shafts 334*a*, 334*b*, 334*c*, a strip breakage monitor 335, a tensioning shaft 336 associated with press rollers 336*a*, a strip return 337, a separating guide 338, and removal brushes 339.

To supplement these unwinding means 330, introduction means 350 are also provided to position the stamping strip 320, and in particular to cause it to pass through the platen press 310. To do that, the introduction means 350 have a loader bar 351 which is mounted transversally mobile in translational movement between the two platen bolsters 311, 312 and, more generally, about the heating upper platen bolster 311. Just like the strip unwinding means 330, the strip introduction means 350, being perfectly well known from the prior art, will not have their operation described in greater detail here.

Finally, the printing device 300 comprises transport means 340 allowing each sheet 10 to be moved individually from the exit of the feed board 200 as far as the collecting station 500, including into the platen press 310.

As can be seen from FIG. 1 and once again in a very conventional way, the transport means 340 use a series of gripper bars 341 which are mounted with the ability to move transversely in translational movement via two sets of chains 342 positioned laterally on each side of the gilding machine 1. Each set of chains 342 runs in a loop which allows the gripper bars 341 to follow a path that passes in succession via the platen press 310, the feed and discharge station 400 and the collection station 500.

In concrete terms, each gripper bar 341 performs an outbound path in a horizontal passage plane between a drive sprocket 343 and a return sprocket 344, then a return path guided by rollers (not visible) in the upper part of the gilding machine 1. Once it has returned to the vicinity of the drive sprocket 343, each gripper bar 341 is then capable of taking hold of a new sheet 10 as shown in FIG. 2.

This FIG. 2 also shows that each gripper bar 341 comprises a transverse bar 345 on which a plurality of grippers 346 are mounted, the grippers being designed so that they can take hold of the front edge of one and the same sheet 10 simultaneously. It will also be noted that each gripper bar 341 is coupled to the two sets of chains 342 via the two respective ends of its transverse bar 345.

According to the subject of the present invention, the printing device 300 further comprises means 360 able to partially restrain each sheet 10 by its rear portion, and do so during the phase of introduction of said sheet 10 into the platen press 310.

According to one particular feature of the invention, the restraining means 360 are able to hold the rear portion of each sheet 10 roughly in the plane of travel of its front edge, during the phase of introduction of said sheet 10 into the platen press 310.

According to another particular feature of the invention, the restraining means 360 comprise a suction member 361 which is positioned upstream of the platen press 310, and which is capable of collaborating through sliding contact with the rear portion of each sheet 10 being introduced into said platen press 310.

According to one currently preferred embodiment of the invention, the suction member 361 is fixed, and is positioned as close as possible to the path followed by the front edge of each sheet 10 just before it is actually introduced into the platen press 310. Such a layout specifically allows the suction member 361 to be systematically in contact with any sheet 10 being introduced into the platen press 310. It also has the advantage of guaranteeing that the sheet is positioned roughly parallel to the internal faces of the platen bolsters 311, 312.

In this exemplary embodiment, each sheet 10 is pulled by a gripper bar 341 as it is introduced into the platen press 310. In concrete terms what this means is that the suction member 360 is positioned in the direct vicinity of the path followed by said gripper bar 341 as it approaches the platen press 310.

However, according to an alternative form of embodiment, the suction member 361 could also be mounted such that it is able to move between an active position 361*a* and a passive position 361*b*. The assembly would then be arranged in such a way that, in the active position 361*a*, the suction member 361 was positioned as close as possible to the path followed by the front edge of each sheet 10 just before it is introduced into the platen press 310, and so that, in the passive position 361*b*, it is positioned some distance away from said path. Of course, the printing device 300 would then comprise means capable of moving the suction member 361 from the passive position 361*b* into the active position 361*a* when the sheet 10 is ready to be introduced into the platen press and, conversely, of moving said suction member 361 from the active position 361*a* into the passive position 361*b* when said sheet 10 is extracted from said platen press 361.

According to one particular feature of this alternative form of embodiment, with the platen press 10 being capable of stamping each sheet 10 between a fixed platen and a moving platen, the suction member 361 is secured to the moving platen; said moving platen then forming the means of movement.

According to one particularly advantageous embodiment, with the hot stamping of each sheet 10 being performed on a given face, known as the printing face, the suction member 361 is positioned on the opposite side to said printing face; said sheet 10 being considered as it approaches the platen press 310. It must nonetheless be understood that it is still entirely possible for the suction member 361 to be installed on the same side as the printing face.

According to one preferred embodiment, the suction member 361 operates continuously. Be that as it may, it is perfectly conceivable for the suction member 361 to be operated discontinuously. In such an event, the printing device 300 will be arranged in such a way that the suction member 361 is activated as soon as the front edge of a sheet 10 arrives plumb with it and is deactivated as soon as the rear of said sheet 10 is no longer in contact with said suction member 310.

In a particularly advantageous manner, the suction member 361 acts over roughly the entire width of each sheet 10 being introduced into the platen press 310.

According to a currently preferred embodiment of the invention, the suction member 361 is of the Bernoulli type, that is to say is a device provided with at least one suction hole where a vacuum (arrow f1) is created through a Venturi effect, by driving air under pressure through a discharge pipe (arrows f2) which communicates laterally with the suction hole and which is provided with a restriction upstream of said suction hole.

Figure 3:
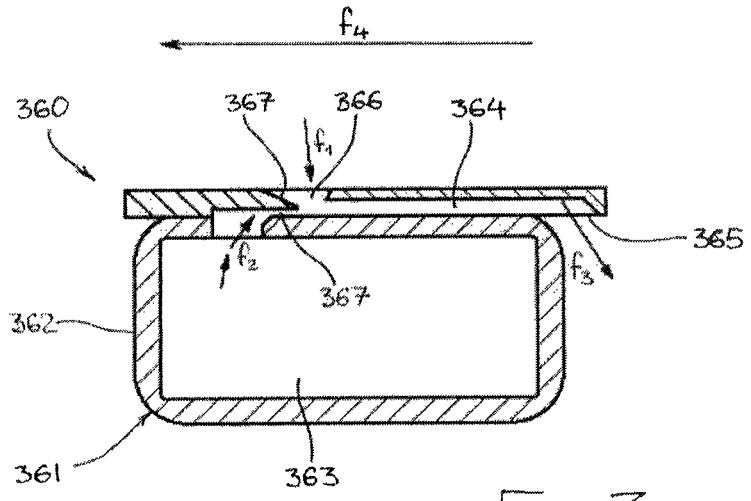
FIG. 3 is a cross section through the suction member with which the printing device of FIG. 2 is equipped.
Figure 4:
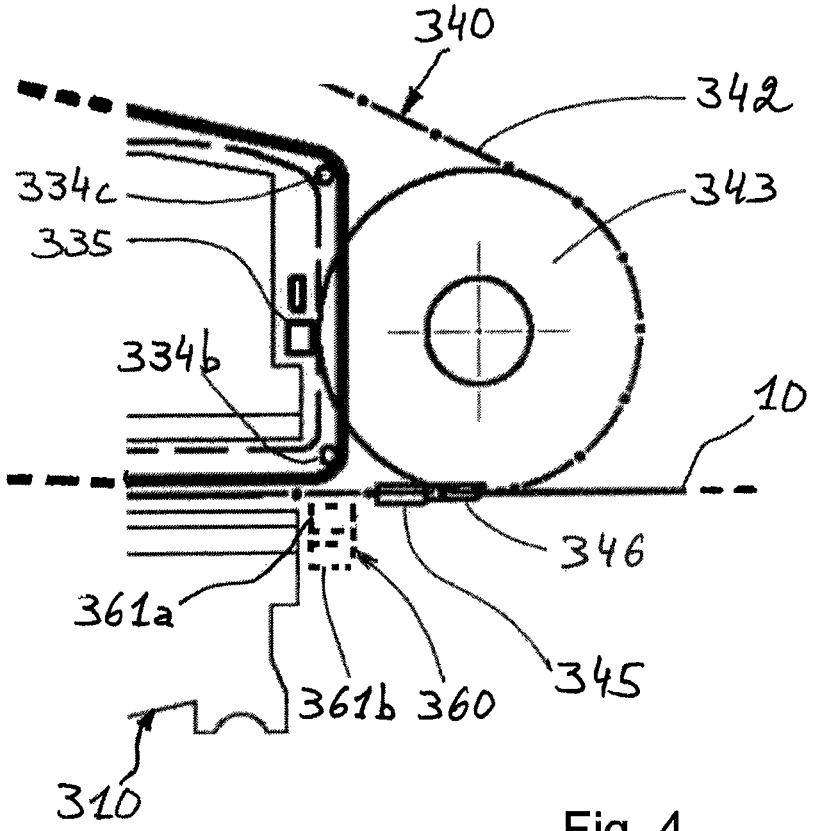
FIG. 4 illustrates an example of a detail of a printing device, according to an aspect of the present disclosure.

In the exemplary embodiment depicted in FIG. 3, the suction member 361 consists of a tablet 362 through which a main pressurized air supply channel 363 is formed longitudinally and communicates with at least one secondary channel 364 running transversely and opening to the rear of the tablet 362 via an individual discharge orifice 365 (arrow f3). Moreover, each secondary channel 364 on the one hand also communicates with a suction orifice 366 which opens onto the face of the tablet 362 that is intended to come into contact with each sheet 10 being introduced into the platen press 310. Finally, each secondary channel 364 has a restriction 367 positioned just upstream of the suction orifice 366. It is understood here that the terms "longitudinally" and "transversely" mean with respect to the body of the tablet 362, whereas the term "rear" is to be understood in relation to the direction of travel of the sheets 10 (arrow 4).

In a particularly advantageous manner, each discharge orifice 365 is directed in opposition with respect to the platen press 310 and with respect to the plane of travel of each sheet 10 as it approaches said platen press 310. The objective here is for each discharge air flow (arrow f3) to be directed in a direction that does not disturb the attitude of the sheets 10 as they are introduced into the platen press 310.

According to another advantageous feature, each suction orifice 366 has a conical shape opening out toward the outside, notably in the region of its portion 367 closest to the platen press 310. The objective here is to prevent any corner of the front edge of the sheet 10 from entering a suction orifice 366 of the tablet 362 as said sheet 10 approaches the platen press 310.

Of course, the invention relates more generally to any passing machine 1 for processing elements in the form of sheets 10, which comprises at least one printing device 300 as described hereinabove.

It should be noted that, in the context of the invention, the idea of a processing machine covers a very wide large number of embodiments because of the modular structure of these assemblies. Depending on the number, nature and arrangement of the work stations used, it is in fact possible to obtain a multitude of different processing machines.

It is also important to emphasize that there exist work stations of types other than those already mentioned in the context of the description of the gilding machine 1. Mention here, for example, may be made of cutting stations, separating stations, waste discharge stations, stamping strip loading stations, etc. Finally, it must be understood that one and the same processing machine may very well be fitted with a number of stations of one and the same type.

The invention claim is:

1. A printing device for printing sheet elements, the printing device comprising:

a platen press configured and operable for hot stamping to affix to each sheet element colored or metallized film from at least one stamping strip;

a transport device configured and operable to introduce, during a phase of introducing, each sheet element one after the other into the platen press by pulling the sheet element by a front edge thereof; and a restraining device comprising a suction member including a restraining surface and a suction orifice located in the restraining surface, the suction member being positioned substantially adjacent the platen press and operable to urge a trailing portion of the sheet element against the restraining surface, such that as the sheet element is fed into the platen press as it moves with a sliding contact against the restraining surface and is thereby partially restrained substantially throughout the phase of introducing the sheet element into the platen press;

a fluid flow channel comprising an inlet end and an outlet end, and configured to lead pressurized air; and the suction orifice having a first end opening onto a face of the restraining surface and a second end in fluid communication with the fluid flow channel at a position between the inlet end and the outlet end of the fluid flow channel so as to generate a low pressure region between the first and second ends of the suction orifice.

2. The printing device according to claim 1, wherein the restraining device holds the rear portion of each sheet element generally in a plane of travel of the front edge of the sheet element during the phase of introducing the sheet element into the platen press.

3. The printing device according to claim 1, wherein the suction member is positioned upstream of the platen press in the introduction direction, and the suction member collaborates through sliding contact with the rear portion of each sheet element at least as the sheet element is being introduced into the platen press.

4. The printing device according to claim 3, wherein the suction member acts over approximately an entire width across each sheet element as the sheet element is introduced into the platen press.

5. The printing device according to claim 1, wherein the suction member is fixed and is positioned at the path followed by the front edge of each sheet element just before the sheet element is introduced into the platen press.

6. The printing device according to claim 1, wherein the suction member is mounted in the device to move between an active position in which the suction member is positioned close to a path followed by the front edge of each sheet element just before the front edge of the sheet element is introduced into the platen press, and a passive position in which the sheet element is positioned a distance away from the path;

the printing device comprises a moving device configured and operable for moving the suction member from the passive position into the active position when the sheet element is in a position ready to be introduced into the platen press and, conversely, to move the suction member from the active position into the passive position when the sheet element is extracted from the platen press after passing the platen press.

7. The printing device according to claim 1, wherein one of the platens is operable to provide hot stamping such that the hot stamping of each sheet element is performed on a printing face of the sheet element, and the suction member is positioned on an opposite side of the sheet element from the printing face as the sheet element approaches the platen press.

8. The printing device according to claim 1, wherein the suction member operates continuously.

9. The printing device according to claim 1, wherein the suction member operates discontinuously, and the suction member is activated as the front edge of a sheet element arrives plumb with the suction member, and the suction member is deactivated as the trailing rear of the sheet is no longer in contact with the suction member.

10. The printing device according to claim 1, wherein the suction member is of Bernoulli type.

11. The printing device according to claim 1, wherein the suction member comprises a tablet, and a main pressurized air supply channel extends longitudinally through the tablet;

at least one secondary channel to which the main air supply channel communicates, the at least one secondary channel runs transversely of the tablet and opens to a rear of the tablet via an individual discharge orifice, a suction orifice with which each secondary channel communicates, the suction orifice opens onto a face of the tablet that is intended to come into contact with each sheet element that is being introduced into the platen press, and each secondary channel has a restriction positioned just upstream of the suction orifice.

12. The printing device according to claim 11, wherein each discharge orifice is oriented in opposition in relation to the platen press, and in relation to a plane of travel of each sheet element as the sheet element approaches the platen press.

13. The printing device according to claim 11, wherein each suction orifice has a conical shape opening out toward the outside in a region of a portion of the suction orifice closest to the platen press.

14. A processing machine for processing sheet elements, the machine comprising at least one printing device according to claim 1.

* * * * *